FIP8502 XR 4,434,968

United States Patent [19]

Smith

[11] 4,434,968

[45] Mar. 6, 1984

[54] MAGNETIC JACK

[76] Inventor: Raymond H. Smith, Rte. 2 - 5AAA, Larned, Kans. 67550

[21] Appl. No.: 306,250

[22] Filed: Sep. 28, 1981

[51] Int. Cl.[3] ..... B66F 3/00

[52] U.S. Cl. ..... 254/1; 310/12

[58] Field of Search ..... 254/1; 269/8, 216; 318/119, 135; 310/12–14, 30; 335/266–268, 257, 277, 306; 267/141.1; 298/562, 566, 636; 104/281–282; 308/10

[56] References Cited

U.S. PATENT DOCUMENTS

| | | | |
|---|---|---|---|
| 1,672,807 | 6/1928 | Etzel | 318/119 |
| 2,117,264 | 5/1938 | Workman | 267/141.1 |
| 3,007,676 | 11/1961 | Javorik | 254/1 |
| 3,158,765 | 11/1964 | Polgreen | 318/135 |
| 3,185,909 | 5/1965 | Jahn | 335/268 |
| 3,326,610 | 6/1967 | Baermann | 335/306 |
| 3,454,837 | 7/1969 | Rhodes | 335/268 |
| 3,763,412 | 10/1973 | Detrick et al. | 310/14 |
| 3,941,402 | 3/1976 | Yankowski et al. | 308/10 |
| 4,249,115 | 2/1981 | Putt | 310/34 |
| 4,259,653 | 3/1981 | McGonigal | 310/30 |

*Primary Examiner*—Robert C. Watson

[57] ABSTRACT

A magnetic jack comprising a body consisting of a series of slidably telescoped sections expandable along the jack axis, and a pair of electromagnets disposed between each successive pair of sections, each connected to one section, and having confronting poles of like polarity, so that they repel each other when electric current is supplied thereto, in order to extend the sections along the jack axis. The magnet pairs between successive pairs of body sections may be energized selectively, or the energizing current may be variably adjusted, in order to vary the height and force of the lift provided by the jack.

1 Claim, 4 Drawing Figures

MAGNETIC JACK

This invention relates to new and useful improvements in load-lifting jacks, and has particular reference to magnetic jacks.

The principal object of this invention is the provision of a magnetic jack wherein the lifting force is provided by pairs of electromagnets having confronting poles of like polarity, whereby the well-known repelling effect between like magnetic poles urges said poles apart to furnish the lifting force.

Another object is the provision of a magnetic jack of the character described including a series of said magnetic pairs which function to provide an available total jack lift equal to the cumulative total of the lifts provided by all of the pairs.

A further object is the provision of a magnetic jack of the character described in which the pairs of the series of pairs may be energized selectively, or may be energized by a variable electric current, whereby to adjust both the lift force and the total lift provided by the jack.

A still further object is the provision of a magnetic jack of the character described having means rendering the expansion and contraction thereof smooth and gradual, regardless of the manner in which electric current may be supplied thereto.

Other objects are simplicity and economy of construction, efficiency and dependability of operation, and adaptability for use in a wide variety of applications.

Figure 1:
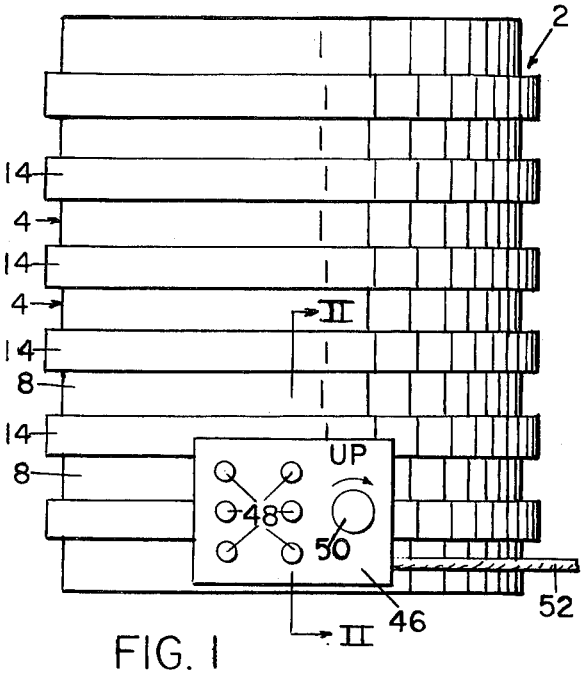
Figure 4:
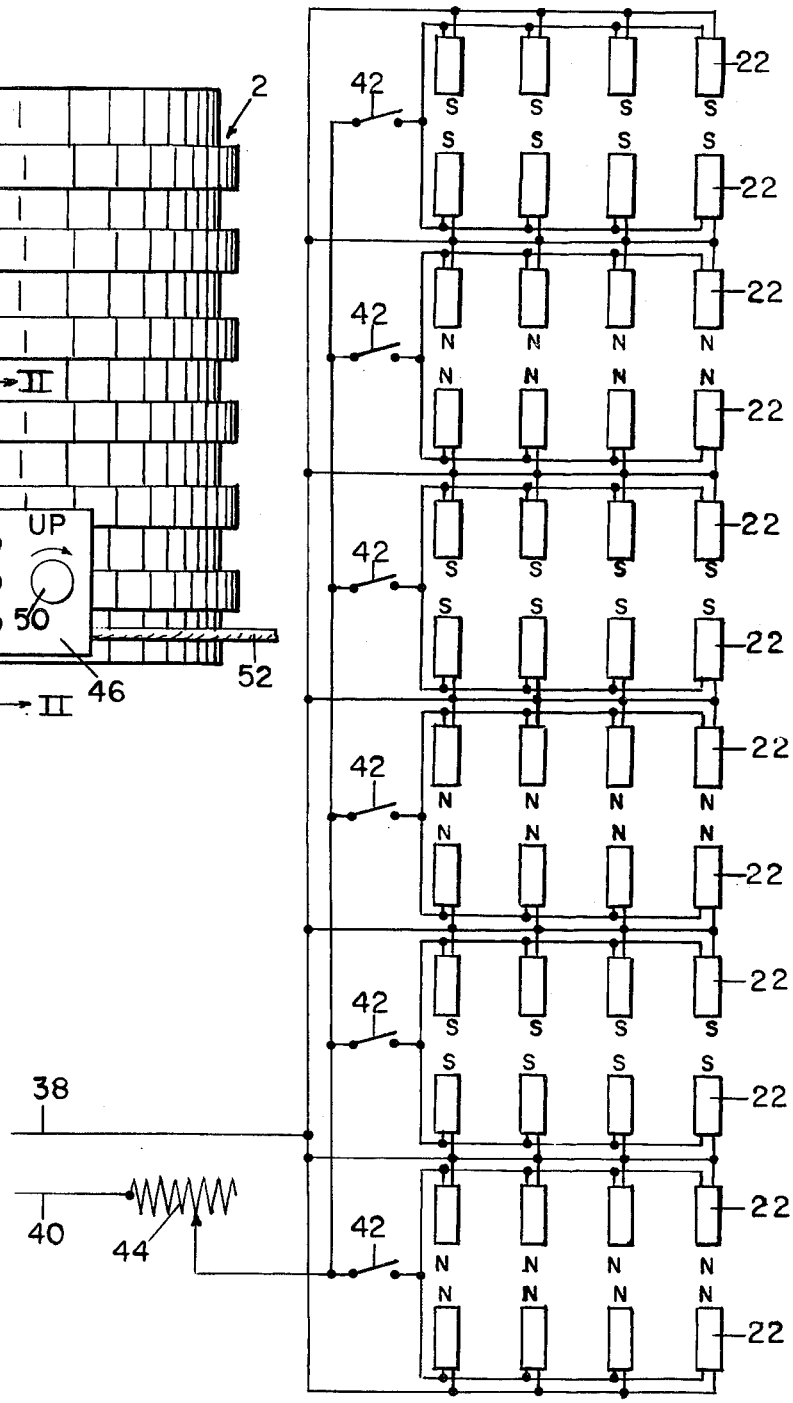
Figure 2:
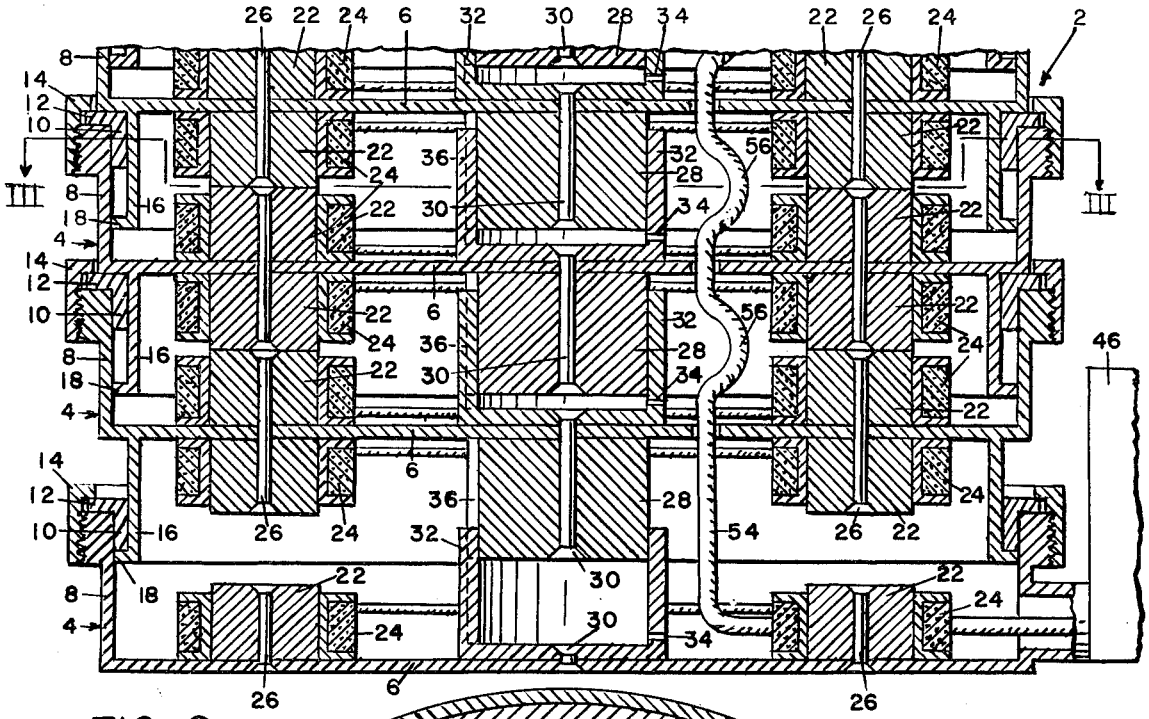
Figure 3:
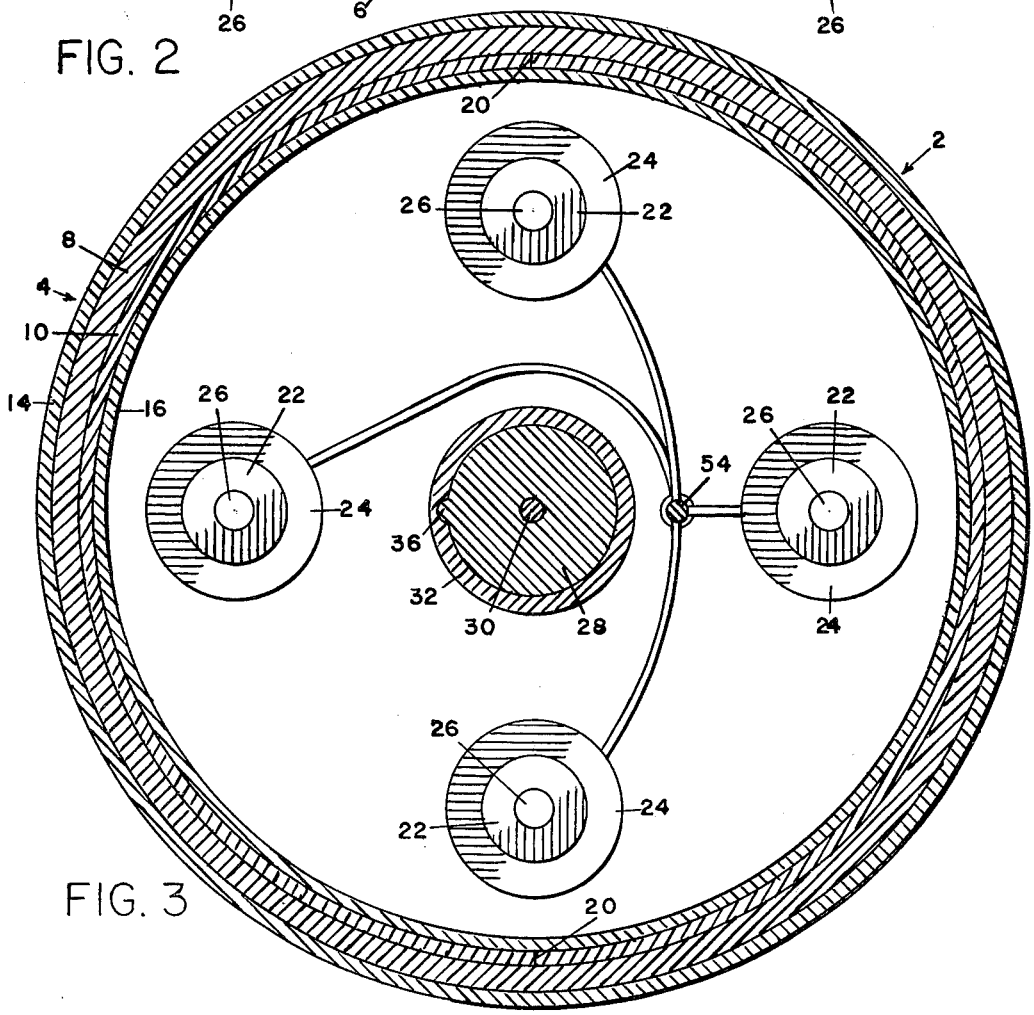

With these objects in view, as well as other objects which will appear in the course of the specification, reference will be had to the accompanying drawing, wherein:

FIG. 1 is a side elevational view of a magnetic jack embodying the present invention, FIG. 2 is an enlarged, fragmentary sectional view taken on line II—II of FIG. 1, with the lowermost pair of body sections extended, FIG. 3 is a sectional view taken on line III—III of FIG. 2, and FIG. 4 is a wiring diagram of the jack.

Like reference numerals apply to similar parts throughout the several views, and the numeral 2 applies generally to the body of the jack. Said jack body is generally cylindrical consisting of a series of sections 4 each constituting a shallow circular pan having a planar floor 6 and a cylindrical side wall 8. These pans are concentrically stacked on a vertical axis. A cylindrical stop ring 10 is fitted snugly and slidably in the upper portion of the side wall of each pan, extending only a portion of the depth of the pan, and having a peripheral flange 12 at its upper end which overlies the top edge of side wall 8, to which it is rigidly clamped by a union ring fastener 14 which overlies stop ring flange 12 and is securely engaged with external threads formed on said wall 8. Of each two successive body sections, the upper is provided with a depending cylindrical skirt 16 of smaller diameter than its floor 6 but concentric therewith, which extends downwardly and slidably through the internal diameter of stop ring 10, and which is provided at its lower edge with an outturned flange 18 which underlies the lower edge of said stop ring. The stop ring may be split diametrically, as indicated at 20 in FIG. 3, in order to permit assembly. Thus the body may be telescopically extended along its vertical axis, each section thereof being movable expandably relative to the next lower section until flange 18 of skirt 16 of the upper section engages the stop ring 10 of the lower section, as shown with respect to the two lowermost sections in FIG. 2.

Disposed between the floors 6 of each successive pair of body sections, there are disposed a plurality of pairs (four as shown) of electromagnets 22, each energized by a supply of electric current, preferably direct current, to its coil 24. The magnets of each pair are arranged with their axes vertical and in vertical alignment one being fixed to floor 6 of the lower pan, and the other to floor 6 of the upper pan, as by rivets 26. The magnet coils 24 of each pair are so wound that their confronting poles are of like polarity, that is, both north poles or both south poles, so that when current is supplied thereto, they repel each other, and hence supply a force tending to telescopically extend the related body sections. The confronting poles may be substantially in contact when the related body sections are fully contracted, and should be sufficiently close even after full extension of said body sections that the magnetic repulsion remains effective. This of course restricts the amount of lift available with only one pair of body sections, but since the lift provided by each pair of body sections is cumulative, any desired lift may be provided by the use of a body including the desired number of sections.

Relative movement of any successive pair of body sections, during either extension or retraction thereof, is rendered smooth and gradual, as compared to the relatively quick "snap" action which would otherwise result from simply making or breaking the electric circuit to the related pairs of magnets, by means of a dashpot arrangement consisting of a vertical plunger 28 affixed centrally to the floor 6 of the upper of any pair of body sections, as by a rivet 30, and movable in a coaxial socket member 32 affixed to the floor of the lower body section of the pair, in the manner of a piston. The socket is sealed except for a small air hole 34 near its bottom. Thus the plunger may move in the socket only as fast as allowed by the entry or exit of air to or from the socket through said air hole, and this speed may be pre-determined by proper selection of the size of said air hole. The plunger may be provided with an external rib 36 movable in a corresponding groove of the socket, whereby to prevent relative axial rotation thereof, and thereby to maintain the magnet pairs of the related body sections in proper axial alignment.

Referring to the wiring diagram of FIG. 4, it will be seen that all of the electromagnets of all of the body sections are connected in parallel with a pair of circuit line wires 38 and 40, with the magnets of each successive pair of body sections under the separate control of a manual switch 42, and with an adjustable rheostat 44 controlling the current to all of the magnets. Switches 42 and rheostat 44 are carried in a control box 46 affixed to the lowermost of body sections 4. As shown in FIG. 1, said control box carries a plurality of pushbuttons 48, corresponding in number to switches 42 and each controlling one of said switches, and a knob 50 controlling rheostat 44. Current is supplied to the control box by an electric cable 52, and the necessary leads to the magnets are contained in a cable 54 which enters body member 2 in its lowermost section and proceeds upwardly therethrough, passing through holes provided therefor in the floors 6 of the body sections. Cable 54 is provided with sufficient slack, as indicated at 56, to permit telescopic extension of said body sections.

In use, the floor 6 of the lowermost body section is supported on a suitable base, and the topmost body section is positioned to engage the load to be lifted. The jack may then be operated in either of two generally different methods. In the first method, rheostat 44 is set for zero resistance, and switches 42 are closed one at a time by means of pushbuttons 48. The closure of each switch activates the magnet pairs associated with one successive pair of body sections 4, which then are repelled by their like polarity to telescopically extend that pair of body sections. Only the number of manget sets necessary to produce the desired distance of lift need be activated. This method is generally preferable where the load is relatively light and the lift distance small, since it permits the use of only a part of the magnets and hence reduces the electric power consumption of the jack. In the second method, rheostat 44 is set for maximum resistance, with all of switches 42 closed, and the resistance of the rheostat then gradually reduced to supply current to all of the magnets. This second method is preferable when the load to be lifted is relatively great, since it permits the confronting poles of each magnet pair to remain more closely spaced apart, so that the repulsion force therebetween remains relatively high for any given flow of electric current. This repulsion force drops rapidly as the distance between the poles increases. In the first method, the jack may be lowered by opening switches 42 successively, and in the second method by again gradually increasing the resistance of rheostat 44. The dashpot action provided by plungers 28 and sockets 32 is useful in the first method, in that they render the extension and retraction of the jack body smooth, even and gradual, rather then jerky and abrupt as would be the case if controlled only by "on" or "off" condition of the magnets.

What I claim as new and desire to protect by Letters Patent is:

1. A magnetic jack comprising:

a. a body member consisting of a series of sections connected together for limited telescopic extension in a direction parallel to the lift axis of the jack, b. A pair of electromagnets carried between each successive pair of body sections, the magnets of said pair being affixed respectively to said related pair of body sections, being coaxial and having a magnetic axis parallel to the jack lift axis, and having confronting poles which are of like polarity when electric current is supplied thereto, c. means for furnishing electric current to said electromagnets, whereby the like polarity of said confronting poles generates a repulsion force tending to extend said related body sections telescopically, and d. a dashpot device interconnecting each successive pair of body sections, whereby to cushion and retard the extension and retraction movements of that pair of body sections.

* * * * *